United States Patent [19]

Dziki

[11] Patent Number: 4,664,296

[45] **Date of Patent: * May 12, 1987**

[54] THERMOPLASTIC DISPENSING DEVICE WITH MANUALLY OPERATED FEED MAGAZINE

[75] Inventor: Michael M. Dziki, Woodbury, Minn.

[73] Assignee: Minnesota Mining and Manufacturing Company, Saint Paul, Minn.

[ * ] Notice: The portion of the term of this patent subsequent to Nov. 11, 2003 has been disclaimed.

[21] Appl. No.: 823,824

[22] Filed: Jan. 28, 1986

Related U.S. Application Data

[63] Continuation of Ser. No. 570,245, Jan. 12, 1984, abandoned, which is a continuation-in-part of Ser. No. 456,346, Jan. 7, 1983, Pat. No. 4,452,287.

[51] Int. Cl.[4] ..... B67D 5/62

[52] U.S. Cl. ..... 222/146.5; 222/325; 219/230

[58] Field of Search ..... 222/146.5, 146.2, 146.1, 222/325, 509; 219/230; 425/87, 458; 221/232, 197, 68, 125, 129, 312 C, 312 B, 312 R

[56] References Cited

U.S. PATENT DOCUMENTS

| | | | |
|---|---|---|---|
| 3,204,828 | 9/1965 | Paulsen | 222/146 |
| 3,298,572 | 1/1967 | Newton | 222/145 |
| 3,612,357 | 10/1971 | Ruskin | 222/146.5 |
| 4,457,457 | 7/1984 | Dziki | 222/146.5 |

FOREIGN PATENT DOCUMENTS

| | | | |
|---|---|---|---|
| 20655 | of 1909 | United Kingdom | 221/312 R |

*Primary Examiner*—Joseph J. Rolla
*Assistant Examiner*—David H. Bollinger
*Attorney, Agent, or Firm*—Donald M. Sell; James A. Smith; William L. Huebsch

[57] ABSTRACT

A device for dispensing molten thermoplastic material which an operator grips while using his thumb to press a solid block of the thermoplastic material through a sleeve and into a heated melting chamber from which the molten thermoplastic material is discharged through a nozzle. The device includes a magazine assembly adapted to hold a stack of thermoplastic material blocks which can be moved seriatim into the sleeve by reciprocation of the slide.

2 Claims, 10 Drawing Figures

THERMOPLASTIC DISPENSING DEVICE WITH MANUALLY OPERATED FEED MAGAZINE

CROSS REFERENCE TO RELATED APPLICATION

This application is a continuation of application Ser. No. 570,245 filed Jan. 12, 1984 now abandoned, which is a continuation-in-part of application Ser. No. 456,346 filed Jan. 7, 1983, now U.S. Pat. No. 4,552,287.

TECHNICAL FIELD

This invention relates to devices for dispensing molten thermoplastic materials.

BACKGROUND ART

Many devices are known for dispensing molten thermoplastic materials, such as the prior art devices described in U.S. Pat. Nos. 3,204,828 and 3,298,572.

Generally, such devices comprise a barrel member having an internal melting chamber which communicates with an outlet opening through a nozzle, and a sleeve with a through opening having one end secured to the barrel member with its through opening communicating with the end of the melting chamber opposite the nozzle. The sleeve is adapted to receive an elongate cylindrical block of solid thermoplastic material which fits closely fit within the through opening in the sleeve, with one end portion of the block in the melting chamber and the other end portion projecting through the sleeve. Means are provided for heating the barrel member to melt the end portion of the block therein, and the device includes a handle positioned so that an operator can grip the handle with the fingers of one hand while pressing the block through the sleeve and into the melting chamber with the thumb of that hand to force molten thermoplastic material out of the melting chamber through the nozzle.

While such devices function effectively, a problem can occur after the operator places a second block of thermoplastic material end to end with the block in the sleeve and presses on the outer end of the second block. The operator must hold the second block in place, thus occupying the operator's second hand, which may be needed elsewhere such as to manipulate articles to which the molten termoplastic material is being applied. If the operator does not hold the second block in place and releases the pressure on the second block as must be done to stop the flow of the molten thermoplastic material, or applies pressure in some direction other than axially along the second block before its leading end enters the sleeve, the second block can fall or fly away from the block already in the sleeve, which is inconvenient, distracting, and wasteful of the operator's time.

A device for dispensing molten thermoplastic material described in my U.S. patent application Ser. No. 456,346 filed Jan. 7, 1983, provides, among other things, means for holding and properly positioning a second block of solid thermoplastic material at the end of a block of that material already in a sleeve and a melting barrel of a device of the type described above, even before the second block enters the outer end of the sleeve, thereby freeing the use of the operators second hand for other activities.

That device, however, will hold a maximum of less than three blocks of thermoplastic material, and thus frequent loading of the device is required if the device is used continuously.

DISCLOSURE OF THE INVENTION

According to the present invention there is provided a modification of the device described in my U.S. patent application Ser. No. 456,346 which, in addition to the melting barrel, the sleeve, heating means, and a handle generally of the type described above, further includes a magazine assembly at the outer end of the sleeve opposite the melting chamber. The magazine assembly provides means for holding and properly positioning a lowermost block of thermoplastic material in the magazine assembly in aligned end-to-end relationship with a block of thermoplastic material within the sleeve while affording use of the operator's thumb to press the lowermost block through the sleeve and into the melting chamber, while holding a stack of blocks of thermoplastic material normally above the lowermost block, which stack can be caused to drop down to position the next lowermost block in alignment with the remainder of a block of thermoplastic material that has been pressed through the sleeve by reciprocal movement of a thumb operated slide which provides both a pusher for the lowermost block and a support for the stack of blocks above the lowermost blocks.

Also, preferably at least one inner sidewall of the magazine is formed with a plurality of recesses parallel to the axis of the melting chamber and adapted to partially receive the sides of the blocks, which recesses partially receive the sides of blocks in the stack and restrict them from moving out the open top end of the magazine assembly when the device is tipped on its side.

BRIEF DESCRIPTION OF THE DRAWING

The present invention will be further described with reference to the accompanying drawing wherein like numbers refer to like parts in the several views, and wherein.

BRIEF DESCRIPTION OF THE DRAWING

Figure 1:
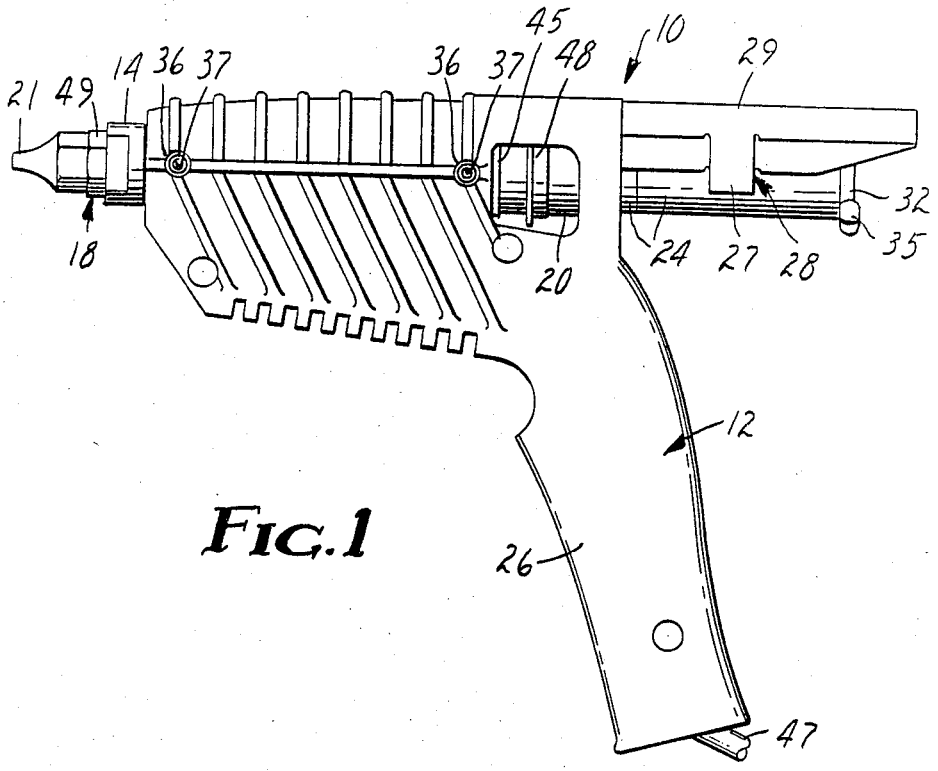
FIG. 1 is a side view of a first embodiment of a dispensing device described in my U.S. patent application Ser. No. 456,346.
Figure 2:
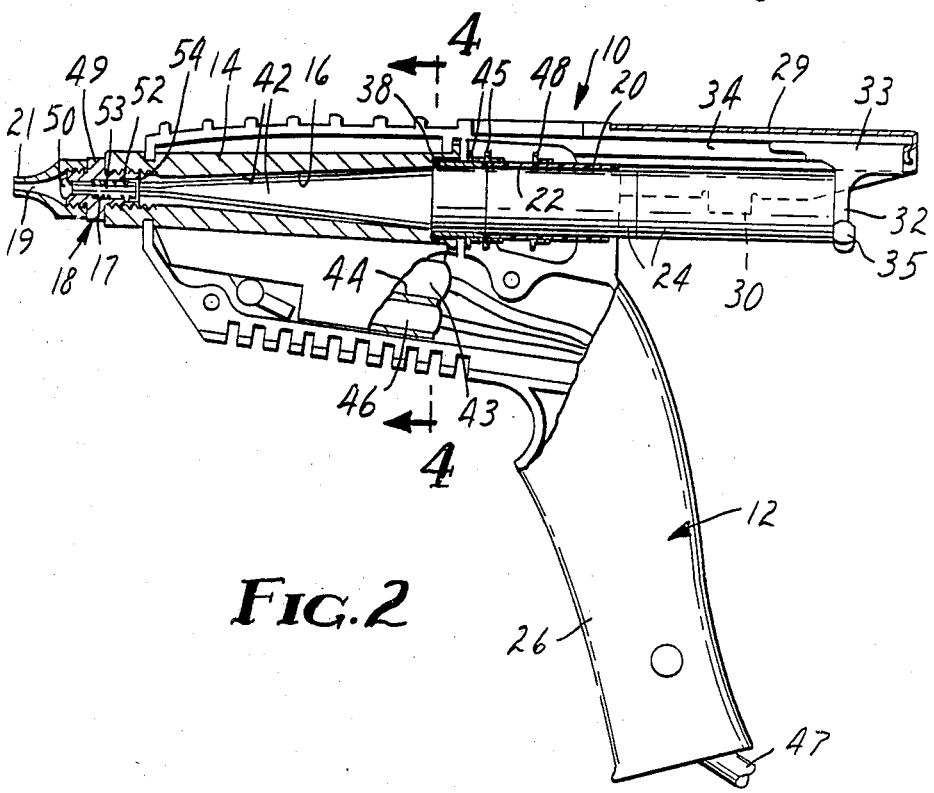
FIG. 2 is a sectional side view of the dispensing device of FIG. 1.
Figure 4:
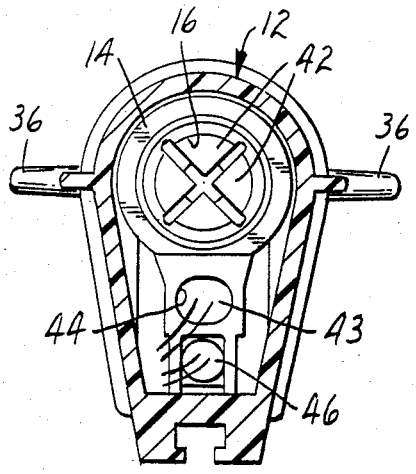
FIG. 4 is an enlarged sectional view taken approximately along lines 4—4 of FIG. 2.
Figure 5:
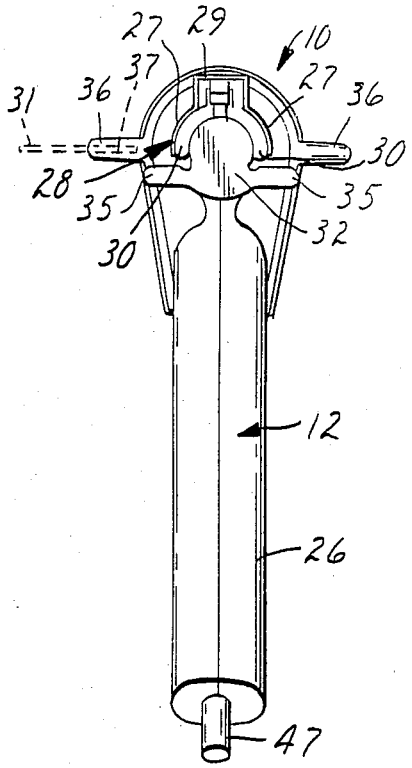
FIG. 5 is an end view of the dispensing device of FIG. 1.
Figure 3:
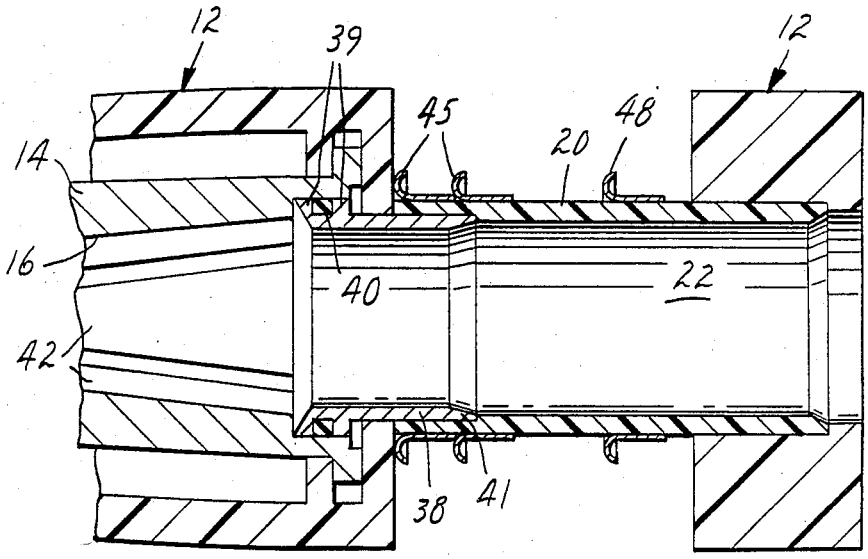
FIG. 3 is an enlarged fragmentary sectional view of a barrel member, a sleeve, and a barrier ring therebetween in the dispensing device of FIG. 1.

Referring now to the drawing there is shown in FIGS. 1 through 5 a dispensing device for molten thermoplastic material generally designated by the reference numeral 10, which was described in my U.S. patent application Ser. No. 456,346 filed Jan. 7, 1983.

Like known prior art dispensing devices for thermoplastic material, the dispensing device 10 comprises a two part frame 12, a barrel member 14 mounted between the parts of the frame 12 and having an internal melting chamber 16 communicating via a discharge passageway 17 through a valve assembly 18 with an outlet opening 19 through a nozzle 21, and a sleeve 20 with a cylindrical through opening 22 having one end secured to the barrel member 14 with its through opening 22 communicating with the end of the melting chamber 16 opposite the discharge passageway 18. The sleeve 20 is adapted to receive a cylindrical block 24 of solid thermoplastic material within the cylindrical through opening 22 with a slight clearance fit even when the diameter of the block 24 is at the large end of its tolerance range, with one end portion of the block 24 in the melting chamber 16 and the block 24 projecting through the opening 22 in the sleeve 20. Means are provided in the device 10 for heating the barrel member 14 to melt the end portion of the block 24 therein. The frame 12 includes a handle 26 positioned so that an operator can grip the handle 26 with the fingers of one hand while applying pressure with the thumb of that hand to press the block 24 through the sleeve 20 and into the melting chamber 16 and force molten thermoplastic material out of the melting chamber 16 through the valve assembly 18 and nozzle 21.

Unlike known prior art devices, the device 10 further includes a bracket assembly 28 at the end of the sleeve 20 opposite the barrel member 14, which bracket assembly 28 includes means adapted for receiving and for holding a second block 24 of solid thermoplastic material in aligned end-to-end relationship with the block 24 of thermoplastic material in the sleeve 20 while affording the application of force by the thumb of an operator on the end of the block 24 opposite the sleeve 20 to press the second block 24 through the sleeve 20 and into the melting chamber 16.

As illustrated, the bracket assembly 28 comprises spaced opposed gripping parts 30 of the frame 12 (FIG. 5) that project toward the handle 26 in a position spaced from the outer end of the sleeve 20 and on opposite sides of an extension of the axis for the sleeve 20. The gripping parts 30 are biased toward each other by spring means comprising a channel-like member 29 of spring steel engaged around the top surfaces of the two parts of the frame 12 to help hold the two parts of the frame 12 together, and having opposed arcuate projecting portions 27 that are biased against the outer surfaces on the gripping parts 30 of the frame 12. The gripping parts 30 have distal ends spaced at a distance that is less than the diameter of the cylindrical block 24 of thermoplastic material, but which distance is sufficient so that the block 24 can be transversely pressed therebetween to resiliently move the gripping parts 30 away from each other in opposition to the biasing of the projecting portions 27 and afford movement of the block 24 therebetween. Also, the gripping parts 30 have concave opposed inner surfaces adapted to conform to and engage the cylindrical side surfaces of a block 24 of thermoplastic material therebetween to hold the block 24 in alignment with a block 24 in the sleeve 20, while affording axial sliding movement of the block 24 and movement of the thumb of the operator between the gripping parts 30 to move the second block 24 into the sleeve 20.

The device also comprises a pressure plate 32 adapted to abut the end of the outermost block 24 of thermoplastic material opposite the melting chamber 16 and to be positioned between the block 24 and the user's thumb to transfer force therebetween. The plate 32 includes an elongate slide portion 33 (FIG. 2) at one edge slidably mounted in a track 34 defined between the parts of the frame 12 to afford movement of the plate 32 with the block 24 and is shaped to pass between the gripping parts 30 so that the plate 32 can be used to push the block 24 fully into the sleeve 20 while directing forces applied to the plate 32 in the longitudinal direction of the block 24, and protects an operator's thumb from contact with the thermoplastic block 24 and from contact with any molten thermoplastic material that (under unusual conditions) might extrude to the outer end of the sleeve 20. The pressure plate 32 includes two wing portions 35, one projecting from each side, which wing portions 35 are positioned to pass under the gripping parts 30 as the pressure plate 32 is used to press the block 24 into the sleeve 20, and either of which wing portions 35 can be manually engaged to move the pressure plate 32 away from the sleeve 20 to facilitate placing a new block 24 of thermoplastic material between the gripping parts 30 after a previous block 24 has been pushed into the sleeve 20.

The two parts of the frame 12 are molded of a suitable high-temperature resistant polymeric material (e.g., the material commercially designated Dupon, Zytel FR50-NC10 available from E. I. duPont deNemours, Wilmington, Del.). Both parts of the frame 12 are formed with spaced posts 36 projecting generally radially outwardly of the barrel member 14, which posts 36 can provide means for spacing the major side surface of the frame 12 and the nozzle 21 of the device 10 from a horizontal surface on which the device 10 is laid, and which posts 36 have sockets 37 adapted to receive end portions of a generally U-shaped wire 31 (FIG. 5) to further space the device 10 away from such a surface should that be desired.

The sleeve 20 is made of a stiff heat-resistive polymeric material (e.g., Teflon®) made by an extrusion process to provide a polished inner surface with microscopic longitudinally extending scratches that facilitates movement of the thermoplastic material through the sleeve 20, particularly after molten thermoplastic has cooled in the sleeve 20 and is again heated by the device 10.

The sleeve 20 is coupled to the barrel member 14 by a metal barrier ring 38 (FIGS. 2 and 3) that is heated by the means for heating the barrel member 14, which barrier ring 38 provides means for restricting the extrusion of molten thermoplastic material between the block 24 and the inner surface of the sleeve 20. The inlet barrier ring 38 is a generally cylindrical member having axially spaced radically outwardly projecting ribs 39 at one end positioned in a cylindrical socket in the end of the barrel member 14, between which ribs 39 is a sealing strip 40 pressed between the barrier ring 38 and barrel member 14 to provide a seal therebetween. An end portion 41 of the barrier ring 38 opposite the barrel member 14 is press fit into an internally relieved area of the sleeve 20. The barrier ring 38 has a cylindrical inside surface that is smaller in diameter than the inside diameter of the sleeve 20 (which sleeve 20 is adapted to always receive a block 24 with a slight clearance fit even when the diameter of the block 24 is at the upper end of its tolerance limits) so that the barrier ring 38 will receive a block 24 having a diameter at the upper end of its tolerance limits with a slight interference fit (e.g., an interference of up to 0.025 cm) or will receive a block 24 having a diameter at the lower end of its tolerance range with a clearance fit of about 0.050 cm. Surprisingly those blocks 24 with a diameter that provides such a slight interference fit with the barrier ring 38 will be melted sufficiently around their periphery by the heated barrier ring 38 that they can be easily pressed into the melting chamber 16, and blocks 24 of thermoplastic material with diameters that provide either such slight interference fits or clearance fits fit sufficiently close in the barrier ring 38 so that no significant amount of molten polymeric material will extrude out of the melting chamber 16 between the block 24 and the barrier ring 38 and toward the outer end of the sleeve 20 between the block 24 and the sleeve 20.

The device 10 also includes three metal (preferably brass) cooling flanges around the outer periphery of the sleeve 20 that provide means for developing predetermined temperature zones in the sleeve 20, including two closely spaced regulating flanges 45 at the end of the sleeve 20 adjacent the barrier ring 38 which cool and regulate the temperature of the molten thermoplastic material in the area between the barrier ring 38 and the sleeve 20, and a cooling flange 48 about centered along the length of the sleeve 20 that cools the sleeve to restrict the thermoplastic material from becoming molten past that area along the sleeve 20, even if the heating means is activated for a long period of time during which molten thermoplastic material is not being dispensed from the device 10.

The barrel member 14 is of a suitable metal (e.g., aluminum). The melting chamber 16 in the barrel 14 is defined by a generally frustoconical inner surface tapered toward the valve assembly 18 to direct the molten polymeric material to the dicharge passageway 17 through the valve assembly 18, and four equally spaced radially inwardly projecting ribs 42 which provide heated contact surfaces in addition to the frustroconical inner surface for engaging and melting the blocks 24 of thermoplastic material as they are pressed into the chamber 16. An electric heating element 43 which heats both the barrel member 14 and the barrier ring 38 is positioned in a socket 44 in the barrel member 14 beneath the chamber 16, and a thermostat 46 is fixed in a channel below the heating element 43 to disconnect electrical power normally supplied the heating element 43 via a power cord 47 and the thermostat 46 when the temperature of the barrel member 14 at the thermostat 46 exceeds a predetermined maximum (e.g., 200° C.).

The valve assembly 18 between the barrel member 14 and the nozzle 21 provides valve means for restricting molten thermoplastic material from running out of the nozzle 21 until a predetermined amount of force (e.g., about 0.9 to 1.8 kilograms) is manually applied to the block 24 of thermostatic material 24 to cause pressure in the molten thermoplastic material in the melting chamber 16. The valve assembly 18 is of the poppet valve type and includes a valve body 49 secured between the barrel member 14 and nozzle 21, which valve body 49 defines the discharge passageway 17 communicating between the melting chamber 16 and the opening 19 through the nozzle 21. The discharge passageway 17 through the valve body 49 is normally closed by a head 50 on a valve normally biased against a valve seat on the end of the valve body 49 adjacent the nozzle 21 by a spring 52 compressed between a flange on the valve body 49 and a perforated retaining disk 54 fixed on a stem 53 of the valve, which disk 54 is axially slidably mounted in the valve body 49. Pressure from molten thermoplastic material in the melting chamber 16 and discharge passageway 17 caused by pressure manually applied to the block 24 of thermoplastic material can move the valve head 50 away from its seat against the bias of the spring 52 and allow molten thermoplastic material to pass the valve head 50 and be discharged through the nozzle 21. When the operator releases such pressure, however, the valve head 50 will again move to its seat under the influence of the spring 52 to prevent any more molten thermoplastic material within the melting chamber 16 and discharge passageway 17 from escaping through the nozzle 21.

To use the dispensing device 10, an operator first connects the power cord 47 to a source of electrical power so that the barrel member 14 and barrier ring 28 are heated by the heating element 43. The operator then places the block 24 of thermoplastic material in the opening 22 through the sleeve 20, grabs the handle 26 with one hand, and uses the thumb of that hand to press against the pressure plate 32 to slide it along the track 34 into engagement with the block 24 and thereby press the block 24 through the sleeve 20 and barrier ring 38 and into the melting chamber 16 in the barrel member 14 where the end portion of the block 24 will be made molten by contact with the inner surface of the barrel member 14, including the inwardly projecting ribs 42. While the inner surface of the sleeve 20 will provide a clearance fit with the periphery of the block 24, even if the diameter of the block 24 is at the upper limit of its tolerance range, the barrier ring 38 has a cylindrical inner surface with a slightly smaller inner diameter than the inner diameter of the sleeve 20 and will provide a slight interference fit or a very close clearance fit with the block 24, depending on whether the diameter of the block 24 is at the upper or lower limit of its tolerance range. If there is an interference fit, the barrier ring 38 will melt the periphery of the thermoplastic block 24 sufficiently to allow it to easily pass; and in either event the barrier ring 38 will greatly restrict extrusion of thermoplastic material from the melting chamber 16 back between the block 24 and the barrier ring 38 and thus between the block 24 and the inner surface of the sleeve 20. Sufficient pressure in the molten thermoplastic within the melting chamber 16 caused by manual pressure on the pressure plate 32 and block 24 will cause the head 50 of the value to move away from its value seat against the bias of the spring 52 so that the molten thermoplastic can flow around the head 50 and out the outlet opening 19 of the nozzle 21. When manual pressure is released on the pressure plate 32, the head 50 will again move to its seat under the influence of the spring 52 which stops the flow of molten material through the nozzle 21 and restricts air from reaching the molten thermoplastic material in the melting chamber 16, thereby restricting oxidation of the molten thermoplastic in the valve assembly 18. If the heating element 43 remains activated for a long time while no molten thermoplastic material is dispensed through the nozzle 21, heat buildup can cause the block 24 to melt (at least around its periphery), to about the midpoint of the sleeve 20 where such melting will be restricted by the cooling effect of the cooling flange 48. If the power is then disconnected so that this molten thermoplastic material cools and solidifies, and the power is then again connected to heat the heating element 43, the thermoplastic material in the valve assembly 18 will be some of the first thermoplastic material melted and the valve assembly 18 can act as a relief valve for pressure developed in the barrel member 14 as the rest of the thermoplastic material in the barrel member 14 melts. Also, the smooth longitudinally microgrooved inner surface of the sleeve 20 will facilitate breaking loose of the block 24 from the sleeve 20 to press it through the barrier ring 38 and into the melting chamber 16 to again cause the molten thermoplastic material to flow out of the nozzle 21.

When the outer end of the block 24 of thermoplastic material reaches the outer end of the sleeve 20, the operator can manually retract the pressure plate 32 along its track 34 via one of the wing portions 35 and press a new block 24 of thermoplastic material transversely between the gripping parts 30 of the holding bracket 28, whereupon the new block 24 will be held in proper alignment with the sleeve 20, and the operator can again use the pressure plate 32 to press the new block 24 into the melting chamber 16.

Figure 6:
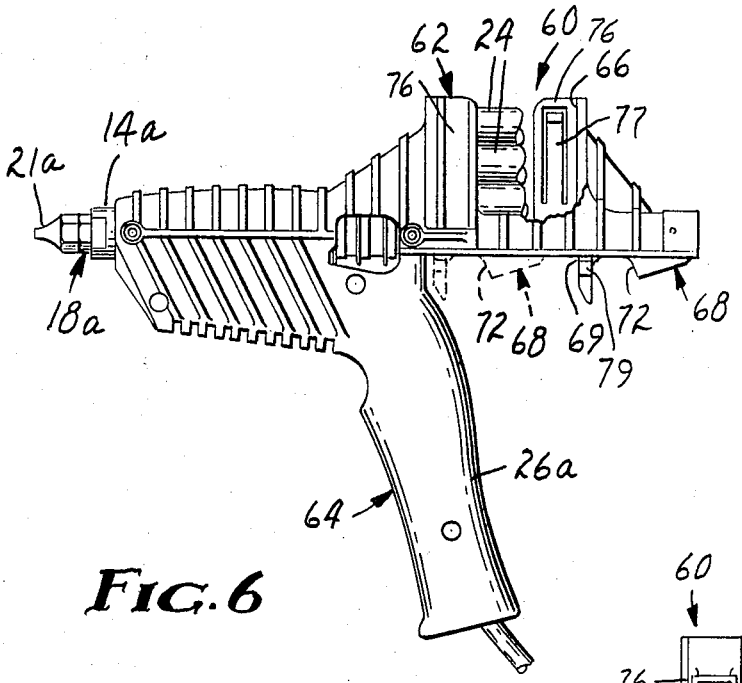
FIG. 6 is a side view of a dispensing device according to the present invention which is similar to the device of FIG. 1 except that it includes a manually operable magazine assembly for holding blocks of solid thermoplastic material to be dispensed through the device.
Figure 7:
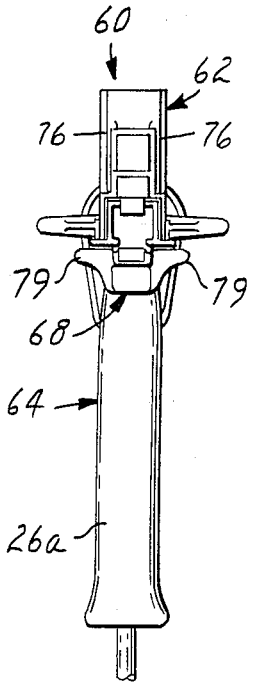
FIG. 7 in an end view of the dispensing device of FIG. 6.
Figure 8:
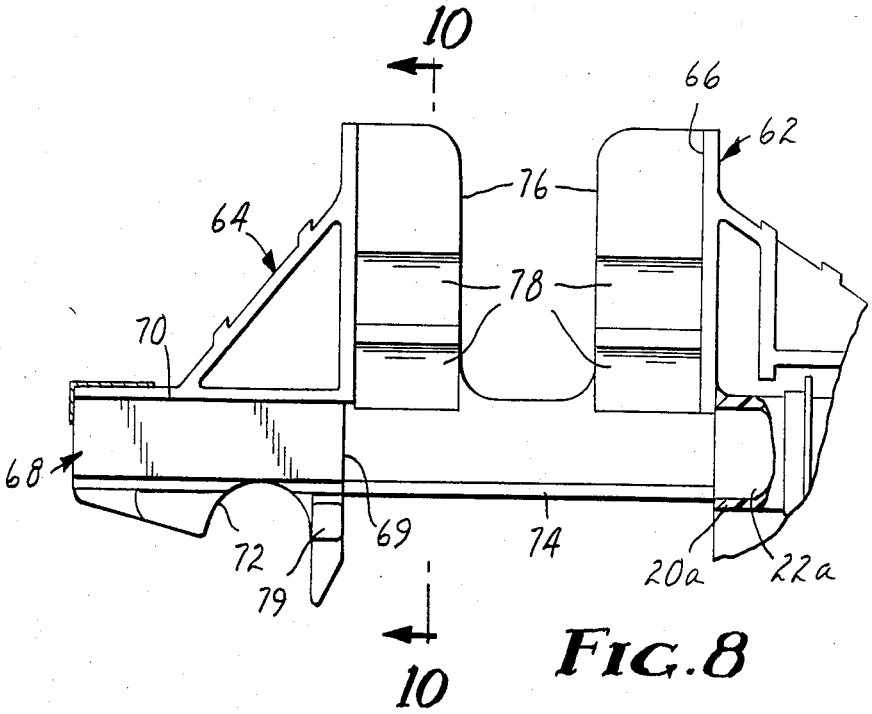
FIG. 8 is an enlarged fragmentary sectional view of the magazine assembly in the device of FIG. 6.
Figure 9:
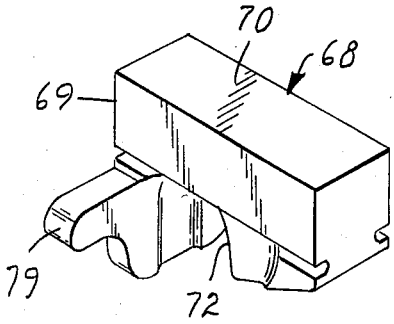
FIG. 9 is an enlarged perspective view of a slide included in the magazine assembly in the device of FIG. 6.
Figure 10:
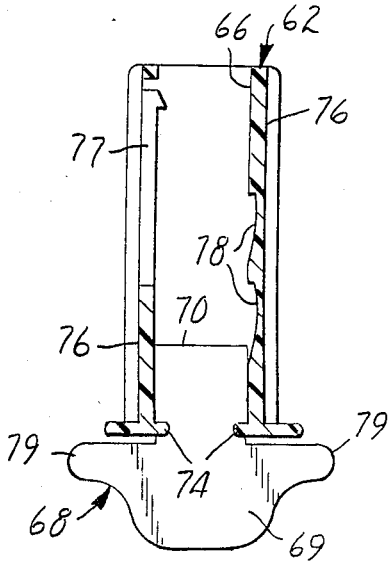
FIG. 10 is a fragmentary sectional view taken approximately along line 10—10 of FIG. 8.

Referring now to FIGS. 6 through 10 of the drawing there is shown a dispensing device 60 for molten thermoplastic material according to the present invention which device 60 has the same structure as the device 10 except that the bracket assembly 28 and slide portion 33 of the device 10 have been replaced by a manually operated magazine assembly 62. Parts of the device 60 that have the same structures as parts of the device 10 have been given the same reference numerals to which have been added the suffix "a".

Like the dispensing device 10 the device 60 comprises a two part frame 64, a barrel member **14*a* mounted between the parts of the frame 64 and having an internal melting chamber communicating via a discharge passageway through a valve assembly 18*a* with an outlet opening through a nozzle 21*a*, and a sleeve 20*a* with a cylindrical through opening 22*a* having one end secured to the barrel member 14*a* with its through opening 22*a* communicating with the end of the melting chamber opposite the discharge passageway. The sleeve 20*a* is adapted to receive a cylindrical block 24 of solid thermoplastic material within the cylindrical through opening 22*a* with a slight clearance fit even when the diameter of the block 24 is at the large end of its tolerance range, with one end portion of the block 24 in the melting chamber and the block 24 projecting through the opening 22*a* in the sleeve 20*a*. Means are provided in the device 60 for heating the barrel member to melt the end portion of the block 24 therein. The frame 64 includes a handle 26*a* positioned so that an operator can grip the handle 26*a* with the fingers of one hand while applying pressure with the thumb of that hand to press the block 24 through the sleeve 20*a* and into the melting chamber to force molten thermoplastic material out of the melting chamber through the valve assembly 18*a* and nozzle 21*a***.

Unlike the device 10, the device 60 includes the magazine assembly 62 at the end of the sleeve **20*a* opposite the barrel member 14*a*, which magazine assembly 62 includes means adapted for receiving and for holding a stack of the blocks 24 of solid thermoplastic material with the lowermost block 24 of the stack in aligned end-to-end relationship with a block 24 of thermoplastic material in the sleeve 20*a* while affording the application of force by the thumb of an operator on the end of the lowermost block 24 opposite the sleeve 20*a* to press it into the sleeve 20*a*** toward the melting chamber.

As illustrated, the magazine assembly 62 comprises (1) wall means or walls included in the frame 64 that define an open topped magazine chamber 66 adapted to hold a stack of the solid thermoplastic material blocks 24 with the lowermost block 24 of the stack in aligned end-to-end relationship with a block 24 of thermoplastic material in the sleeve **20*a*; and (2) an elongate slide 68 having an end surface 69 adapted to engage the end of the lowermost block 24 opposite the sleeve 20*a*, a shape adapted to replace the lowermost block 24 in the stack, and an upper surface 70 adapted to support the other blocks 24 in the stack. Also, the slide 68 has portions projecting away from its side opposite its surface 70 that are longitudinally spaced to provide a notch 72 therebetween opening through its side. The notch 72 is adapted to receive the end portion of an operator's thumb. The slide 68 is mounted on the frame 64 for movement along a path generally aligned with the melting chamber (1) from a retracted position (FIGS. 6 and 8) with the slide 68 out of the magazine chamber 66 and its first end surface 69 adjacent the end of the lowermost block in the magazine chamber 66 opposite the melting chamber (2) to an advanced position (dotted outline in FIG. 6) with the slide 68 extending across the bottom of the magazine chamber 66 to press the lowermost block 24 in the magazine chamber 66 toward the melting chamber by engagement between its first end surface 69 and the block 24, in which advanced position the slide 68 supports the other blocks 24 in the magazine chamber 66 on its upper surface 70; and (3) back to its retracted position to allow the block 24 in the stack adjacent its upper surface 70 to move into alignment with the melting chamber so that the cycle can be repeated. The notch 72 is accessible by the thumb of an operator gripping the handle 26*a* to afford manual reciprocation of the slide 68** between its retracted and advanced positions by the operator.

The walls of the frame 64 which define the magazine chamber 66 include spaced opposed ledges 74 which define a bottom wall for the magazine chamber 66, and the slide 68 has opposite longitudinally grooves extending receive the ledges 74 to afford reciprocation of the slide 68 along the ledges 74 between its retracted and advanced positions.

Also the walls of the frame 64 defining the magazine chamber 66 include spaced vertically extending side walls 76. At least one of the side walls 76 has a plurality of recesses 78 parallel to each other and to the axis of the melting chamber along its inner surface. The recesses 78 are spaced and adapted to partially receive the sides of blocks 24 in the stack of blocks 24 in the magazine chamber 66 to restrict the blocks 24 from moving out the open top of the magazine chamber 66 when the device 60 is tipped on its side adjacent the recesses 78. Two resilient spring fingers 77 with enlarged inwardly projecting heads on their distal ends and positioned adjacent the open end of the magazine chamber 66 also help to retain the stack of blocks 24 in the magazine chamber 66, while being resiliently bendable so that their heads will be cammed out of the magazine chamber as blocks 24 are added to the stack in the magazine assembly 62.

To use the dispensing device 60, an operator first connects its power cord 47 to a source of electrical power so that the barrel member and barrier ring are heated by its heating element. After insuring the slide 68 is then it its retracted position (FIGS. 6 and 8), the operator then places a series of blocks 24 of thermoplastic material in the open end of the magazine chamber 66, grabs the handle 26*a* with one hand, engages the thumb of that hand in the notch 72 in the slide 68 and uses his thumb to move the slide 68 along the ledges 74 into engagement with the lowermost block 24 in the stack to thereby press that block 24 toward the sleeve 20*a* and into the melting chamber in the barrel member 14*a* where the end portion of the block 24 will be made molten by contact with the inner surface of the barrel member 14*a*. As the slide 68 is thus moved from its retracted position toward its advanced position (dotted outline in FIG. 6) it will replace the lowermost block 24 in the magazine chamber and support the other blocks in the magazine chamber 66 on its upper surface 70.

When the outer end of the thermoplastic material and the end surface 69 of the slide 68 reach the outer end of the sleeve 10*a*, (the advance position of the slide 68) the operator can manually retract the slide 68 along the ledges 74 by engagement of his thumb in the notch 72 or on one of a pair of projecting wing portions 79, so that the lowermost block 24 of thermoplastic material remaining in the magazine chamber will move to the bottom of the magazine chamber 66 in proper alignment with the sleeve 20*a*, and the operator can again manipulate the slide 68 with his thumb to press the new lowermost block 24 in the magazine chamber 66 into the sleeve 20*a* and the melting chamber.

The present invention has now been described with reference to one embodiment thereof. It will be apparent to those skilled in the art that many changes can be made in the embodiment described without departing from the scope of the present invention. For example, the device 60 could incorporate the features described with reference to drawing FIGS. 6 and 7 of my U.S. patent application Ser. No. 456,346. Also recesses 78 of the type illustrated could be used on the other sidewall defining the magazine chamber 66 instead of the spring fingers 77. Thus the scope of the present invention should not be limited to the structures described in this application, but only by structures described by the language of the claim and their equivalents.

I claim:

1. A device for dispensing molten, thermoplastic material comprising a frame including a handle positioned so that an operator can grip the handle with the fingers of one hand; a barrel member mounted on said frame and having an internal melting chamber communicating with an outlet opening through a nozzle; a sleeve with a through opening having one end secured to said barrel member with said through opening communicating with the end of said melting chamber opposite said outlet opening, said sleeve being adapted to receive a block of solid thermoplastic material with one end portion of the block in the melting chamber and the block projecting through said sleeve; means for heating said barrel member to melt the end portion of the block therein; and a magazine assembly at the end of said sleeve opposite said melting chamber comprising wall means included in said frame and defining an open topped magazine chamber adapted to hold a stack of solid thermoplastic material blocks with the lowermost block in aligned end-to-end relationship with a said block of thermoplastic material in said sleeve, and a slide having an end surface adapted to engage the end of a said block opposite said sleeve, having a shape adapted to replace the lowermost block in the stack, having an upper surface adapted to support blocks in the stack on said upper surface, having portions projecting from the side of the slide opposite said upper surface in a direction generally at a right angle with respect to said upper surface, which portions are spaced apart to define a notch therebetween opening through the side of the slide opposite said upper surface adapted to receive the end portion of an operator's thumb, and being mounted on said frame for movement along a path generally aligned with the melting chamber (1) from a retracted position with the slide out of the magazine chamber and said first end adjacent an end of the lowermost block in the magazine chamber opposite said melting chamber (2) to an advanced position with said slide extending across the bottom of said magazine chamber to press the lowermost block in the magazine chamber toward the melting chamber by engagement between said first surface and the block and to support the other blocks in the magazine chamber on said upper surface, and (3) back to said retracted position to allow another block in the stack to move into alignment with the melting chamber, said notch being accessible by the end portion of the thumb of an operator gripping said handle portion to afford manual reciprocation of said slide between said retracted and advanced positions by the operator; said wall means defining said magazine chamber including spaced vertically extending side walls, and at least one of said side walls having a plurality of recesses parallel to the axis of the melting chamber along its inner surface, said recesses being spaced and adapted to partially receive the sides of blocks in a said stack of blocks in the magazine chamber to restrict the blocks from moving out the open top of the magazine chamber when the device is tipped on its side.

2. A device according to claim 1 wherein said wall means comprises spaced opposed ledges defining a bottom wall for said magazine chamber, and said slide has opposite longitudinal grooves receiving said ledges to afford reciprocation of said slide along said ledges between said retracted and advanced positions.

* * * * *